United States Patent [19]

Benjamin

[11] Patent Number: 4,795,868

[45] Date of Patent: Jan. 3, 1989

[54] TILT SWITCH

[76] Inventor: Harry Benjamin, 8167 Anderson NE., Warren, Ohio 44484

[21] Appl. No.: 152,963

[22] Filed: Feb. 8, 1988

[51] Int. Cl.[4] ..... H01H 29/22

[52] U.S. Cl. ..... 200/220; 200/188; 200/61.47

[58] Field of Search ..... 200/220, 224, 229, 187, 200/188, 189, 153 A, 61.46, 61.47, 61.52

[56] References Cited

U.S. PATENT DOCUMENTS

| | | | |
|---|---|---|---|
| 2,720,569 | 10/1955 | Schoeppel et al. | 200/220 |
| 3,876,850 | 4/1975 | Amberny | 200/224 |
| 4,135,067 | 1/1979 | Bitko | 200/220 |

FOREIGN PATENT DOCUMENTS

| | | | |
|---|---|---|---|
| 2496332 | 6/1982 | France | 200/220 |

*Primary Examiner*—Renee S. Luebke
*Attorney, Agent, or Firm*—Harpman & Harpman

[57] ABSTRACT

A switch responsive to movements such as those occurring in a boat with respect to a horizontal plane is provided with electrical contacts arranged in a circular pattern in proximity to a fluid electrical conductor in a shallow annular chamber. The electrical contacts are arranged in two groups, the contacts of one group being positioned between the contacts of the other group so that an electrical circuit may be established by the fluid conductor between any of a number of pairs of the electrical contacts depending upon the tilting of the switch and the resultant positioning of the fluid conductor. Electrical circuits so established are useful in actuating devices, such as solenoids, and the movement of the cores thereof may be used to control stabilizing fins on a boat to overcome sideward tilting of the boat with respect to horizontal.

7 Claims, 2 Drawing Sheets

TILT SWITCH

BACKGROUND OF THE INVENTION

1. Technical Field

This invention relates to tilt switches utilizing a fluid conductor arranged so that tilting the switch in any direction results in closing an electrical circuit between contacts in the switch arranged in proximity to the fluid conductor.

2. Description of the Prior Art

Prior switches of this type may be seen in U.S. Pat. Nos. 3,984,674, 4,363,021 and 4,528,851. This invention resembles the switching device of U.S. Pat. No. 4,363,021 and eliminates the limitations of the switching device therein disclosed and provides a simpler, less expensive construction resulting in readily adjustable contacts enabling the sensitivity of the tilt switch to be desirably controlled.

SUMMARY OF THE INVENTION

A tilt switch comprises a pair of superimposed body members having matching configurations defining an annular shallow channel in which a fluid electrical conductor is contained. A plurality of circumferentially spaced pointed contact members are adjustably positioned through the upper one of the body members for adjustment toward and away from the fluid electrical conductor. A plurality of secondary contact members are arranged in circumferentially spaced relation to one another and positioned alternately between the pointed contact members, the secondary contact members being electrically connected to one another and a central contact so that when tilted the tilt switch will complete an electric circuit between one or more of the pointed contact members and at least one of the secondary contact members.

DESCRIPTION OF THE PREFERRED EMBODIMENT

Figure 1:
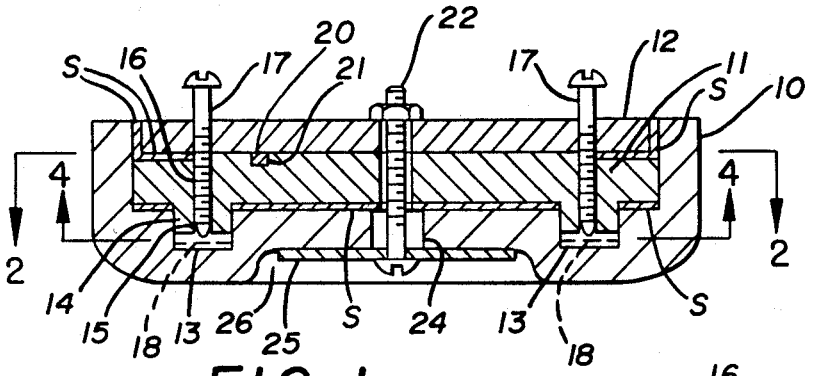
FIG. 1 is a vertical section of the tilt switch.
Figure 2:
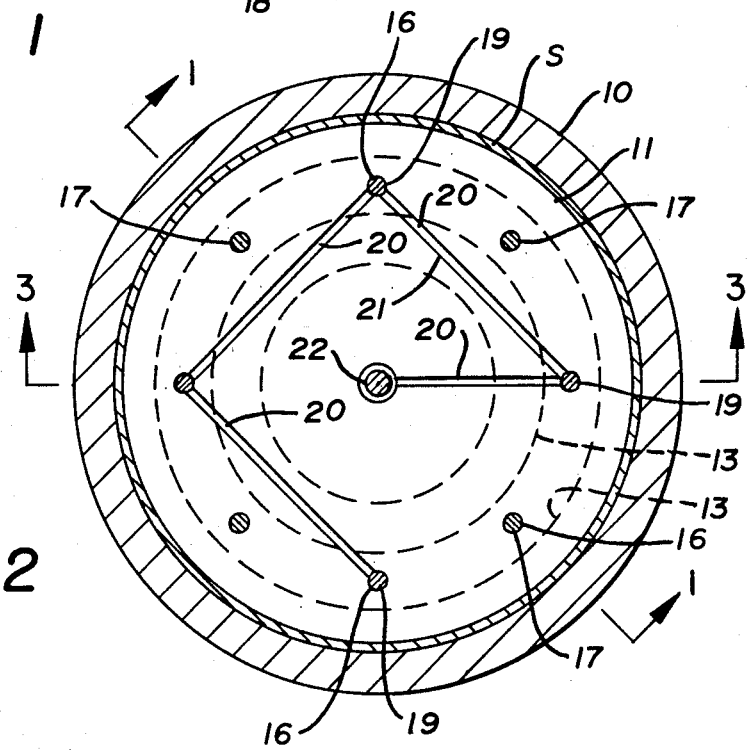
FIG. 2 is a horizontal section of line 2—2 of FIG. 1.
Figure 3:
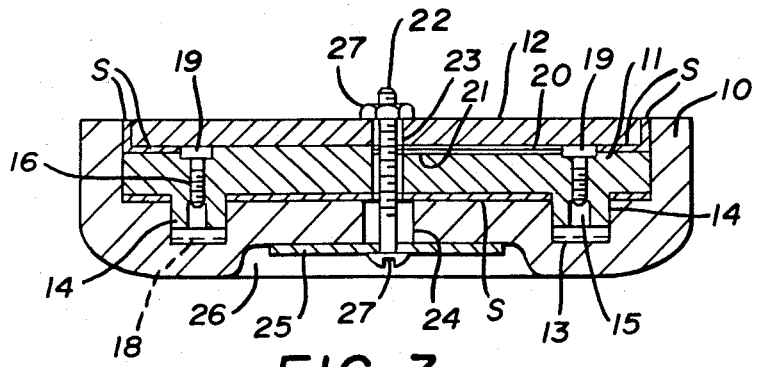
FIG. 3 is a vertical section on line 3—3 of FIG. 2.

By referring to FIGS. 1,2 and 3 of the drawings, it will be seen that a tilt switch designed to be normally mounted in a horizontal position is illustrated as comprising superimposed main and secondary circular generally flat body members 10 and 11 and a circular cover 12. An annular upstanding flange is preferably formed on the periphery of said main body member. The main body member 10 is formed with an annular shallow channel 13 therein and the secondary body member 11 is formed with a depending annular rib 14 thereon. The depending annular rib 14 is located on the secondary body member 11 so as to register in the annular shallow channel 13 to partially fill the same and form a closure with respect thereto and more importantly provide means depending into the annular shallow channel 13. An annular groove 15 is formed upwardly in the lower surface of the depending annular rib 14 and a plurality of vertical bores 16 are formed in the secondary body member 11 in communication with the annular groove

15 and positioned in circumferentially spaced relation to one another. A plurality of pointed contact members 17 are positioned alternately in the bores 16, the bores 16 and the pointed contact members 17 having matching thread patterns so that rotation of the pointed contact members 17 adjustably positions their pointed ends in the annular shallow channel 13 where they will contact a liquid electric conductor, such as mercury 18, positioned in the lower portion of the annular shallow channel 13 as best seen in FIG. 1 of the drawings.

In FIG. 1 of the drawings, the uppermost ends of the pointed contact members 17 may be seen to be provided with transverse slots in which a tool, such as a screwdriver, may be engaging for rotating the pointed contact members 17 in adjusting the same.

By referring to FIGS. 2 and 3 of the drawings, it will be seen that a plurality of secondary contact members 19 are alternately positioned in the circumferentially spaced bores 16 with their lowermost or contact ends reaching the uppermost portion of the annular groove 15 in the annular rib 14 of the secondary body member 11 so that they are spaced a substantially greater distance above the liquid electrical conductor such as mercury 18 in the lower part of the annular shallow chamber 13.

By referring to FIG. 3 of the drawings, it will be seen that the lowermost ends of each of the secondary contact members 19 are elevated with respect to the pointed ends of the contact members 17 so that the ends are at different levels on different horizontal planes and therefore differently positioned with respect to the fluid electrical conductor such as mercury 18. The bores 16 and the secondary contact members 19 have matching thread patterns and receiving configurations in the upper ends of the secondary contact members 19 providing for the reception of appropriately shaped wrenches for rotating the same. The secondary contact members 19 are countersunk with respect to the upper surface of the secondary body 11 and conductors 20 positioned in grooves 21 in the upper surface of the secondary body 11 extend between and connect to the secondary contact members 19 and a center bolt 22 which extends through openings 23 and 24, respectively, in the secondary body member 11 and body member 10. The lower end of the bolt 22 has a head which engages an apertured plate 25 positioned in a recess 26 on the bottom of the main body member 10. A nut 27 on the other end of the bolt 22 registers against the cover 12 to hold the assembly of the body members 10, 11 and cover 12 which are also provided with sealing material S positioned between the respective engaging portions of these members to insure the retention of the respective parts in desired relation and prevent leakage of the fluid electrical conductor, such as the mercury 18.

Figure 4:
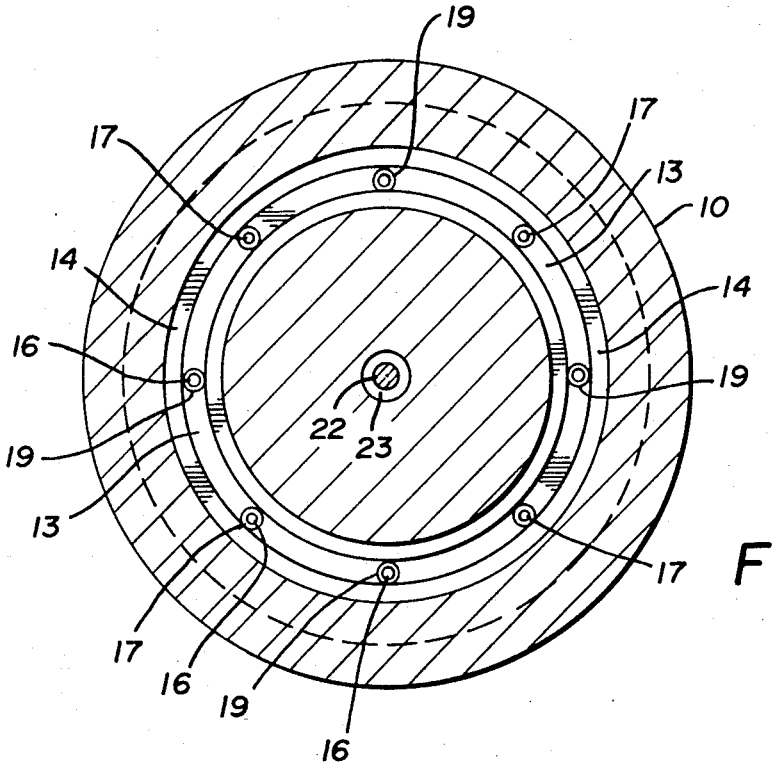
FIG. 4 is a horizontal section on line 4—4 of FIG. 1.

By referring to FIG. 4 of the drawings which is taken looking upwardly on line 4—4 of FIG. 1, the circumferential spacing of the contact ends of the pointed contact members 17 and the blunt ends of the shorter secondary contact members 19 may be seen positioned in the bores 16 which in turn communicate with the annular groove 15 formed upwardly in the annular rib 14 of the secondary body member 11.

Figure 5:
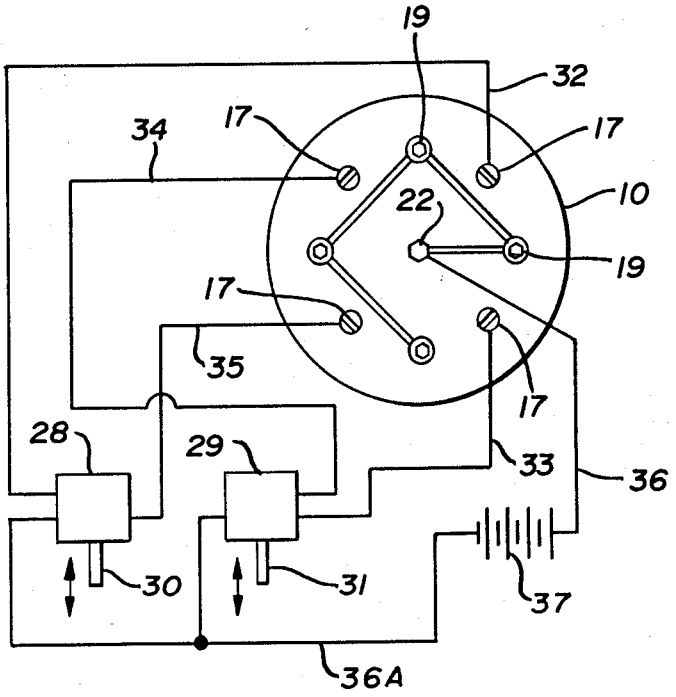
FIG. 5 is a diagrammatic wiring diagram illustrating an example of one of the uses of the tilt switch.

In FIG. 5 of the drawings, a schematic diagram illustrates an example of one use of the tilt switch of the invention, the example mounting the switch main body 10 horizontally on a boat equipped with leveling devices, such as stabilizing fins, positioned therebeneath on either side of the propeller. In FIG. 5, double acting solenoids 28 and 29 each have a pair of coils therein, not shown, and a core arranged to be moved thereby so as to move control rods 30 and 31 respectively toward and away from the double acting solenoids. The control rods 30 and 31 may be connected to stabilizing fins on either side of the rudder of the boat as will be understood by those skilled in the art. An electrical conductor 32 extends from one of the pointed contact members 17 of the tilt switch to one of the coils in the double acting solenoid 28 which when energized would move the control rod 30 toward the solenoid body and a stabilizing fin controlled thereby upwardly with respect to a boat on which it was pivoted. An electrical conductor 33 extends from one of the pointed contact members 17 on the same side of the tilt switch to the second coil in the solenoid 29 where energization will move the core thereof and the connected control rod 31 outwardly of the solenoid body so as to move a stabilizer fin on a boat downwardly. Two other pointed contact members 17 on the left side of the tilt switch seen in FIG. 5 and indicated by the body 10 are connected by conductors 34 and 35 to the first and second solenoid coils in the double acting solenoids 29 and 28 respectively, so that energization of the same will move the control rods 30 and 31 in the opposite direction to that hereinbefore described and thus raise a stabilizing fin on the right side of a boat adjacent the propeller and lower a stabilizing fin on the left side of the boat on the opposite side of the propeller. The several secondary contact members 19 are connected to one another as in FIG. 2 of the drawings and hereinbefore described and the center post 22 of the tilt switch is connected by a conductor 36 to a power source, such as a battery 37 from which a conductor 36A extends to each of the solenoids 28 and 29 where it is connected to each of the first and second solenoid coils therein as will be understood by those skilled in the art.

In this simple example of the use of the tilt switch invention, it will be seen that when the tilt switch is moved so that its right hand side as seen in FIG. 5 of the drawings moves downwardly from its normal horizontal plane, the mercury 18 in the annular shallow channel 13 of the device will contact one or both of the pointed contact members 17 as illustrated in FIG. 5 as well as the blunt ended elevated contact 19 closing circuits to the coils in the double acting solenoids 28 and 29 which will move the cores in opposite directions and therefore move the stabilizer fins so as to cause the boat to resume a normal horizontal plane. If the tilting motion imparted to the tilt switch is such that the mercury 18 contacts only one of the pointed contact members 17 on the right side of the tilt switch 10 as seen in FIG. 5, for example the contact in connection with the electrical conductor 33, the resulting action will be energization of one of the coils in the double acting solenoid 29 and the movement of the core therein and the control rod 31 outwardly of the solenoid so as to move the connected stabilizer downwardly while no connection is made with the double acting solenoid 38 and the stabilizer fin on the left side the of boat remains in neutral or horizontal position. Thus a minor tilting action results in a minor correction.

Those skilled in the art will observe that a number of the contacts may be provided and that by interconnecting the same with solenoids or other devices useful in signaling, lighting or correcting the stabilization of a boat may be energized. It will also be seen that the degree of sensitivity of the tilt switch disclosed herein may be easily adjusted as hereinbefore described.

Having thus described my invention what I claim is:

1. An improvement in a tilt switch for use in sensing and signaling tilting of an article to which the tilt switch is affixed, the improvement comprising defining an annular shallow channel in a generally flat member, means registering with said flat member and said annular shallow channel partially filling, sealing and enclosing said annular shallow channel, electrically conductive fluid partially filling said annular shallow channel, and a plurality of circumferentially spaced vertically positioned first contact members having lower ends closely spaced with respect to said electrically conductive fluid in said shallow channel, a plurality of circumferentially spaced secondary contact members arranged alternately between said first contact members, said secondary contact members being vertically arranged and having their lower ends positioned in a cavity formed inwardly of said means registering with said annular shallow channel so as to space the lower ends of said secondary contact members with respect to said electrically conductive fluid, electrical conductors in said means registering with said flat member interconnecting said secondary contact members and a center post conductor, and means fastening said flat member and said means registering therewith to one another.

2. The improvement specified in claim 1 wherein said generally flat member is a circular body member having an upstanding annular flange thereon radially spaced with respect to said annular shallow channel and wherein said annular means registering with and partially filling and enclosing said annular shallow channel comprises a secondary circular body member positioned on said circular body member in the area defined by said upstanding annular flange and having an annular rib on the lower surface thereof partially positioned in said annular channel.

3. The improvement specified in claim 1 wherein said generally flat member is a circular body member having an upstanding annular flange on its peripheral edge and said means registering with said generally flat member is a secondary circular body member positioned on said circular body member in the area defined by said upstanding annular flange and wherein said means registering with and partially filling and enclosing said annular shallow channel comprises an annular rib formed on said secondary circular body member, said cavity comprising an annular groove formed in said annular rib.

4. The improvement specified in claim 1 and wherein a cover is positioned on said means registering with said flat member so as to cover and enclose said electrical conductors.

5. The improvement specified in claim 1 wherein said generally flat member is a circular body member having an upstanding annular flange on its peripheral edge and the means registering with said flat member is a secondary circular body member positioned on said circular body member in the area defined by said upstanding annular flange and wherein a circular cover is positioned on said secondary circular body member in the area defined by said upstanding annular flange on said circular body member, sealing material positioned between said cover and said upstanding annular flange and between said secondary circular body member and said circular body member.

6. The improvement specified in claim 1 wherein said generally flat member is a circular body member having an upstanding annular flange on its peripheral edge and the means registering with said flat member is a secondary circular body member positioned on said circular body member in the area defined by said upstanding annular flange and wherein a circular cover is positioned on said secondary circular body member in the area defined by said upstanding annular flange on said circular body member, sealing material positioned between said cover and said upstanding annular flange and between said secondary circular body member and said circular body member, said means fastening said flat member and said means registering therewith to one another comprising a bolt positioned centrally of said plurality of circumferentially spaced contact members and secondary contact members and forming said center post conductor.

7. The improvement specified in claim 1 and wherein said electrically conductive fluid in said annular shallow channel is a quantity sufficient to engage no more than three of said circumferentially spaced first and secondary contact members.

* * * * *